US008253052B2

(12) United States Patent
Chen

(10) Patent No.: US 8,253,052 B2
(45) Date of Patent: Aug. 28, 2012

(54) KEYBOARD DOME STIFFENER ASSEMBLY

(75) Inventor: Chao Chen, Waterloo (CA)

(73) Assignee: Research In Motion Limited, Waterloo (CA)

( * ) Notice: Subject to any disclaimer, the term of this patent is extended or adjusted under 35 U.S.C. 154(b) by 298 days.

(21) Appl. No.: 12/710,996

(22) Filed: Feb. 23, 2010

(65) Prior Publication Data

US 2011/0203913 A1 Aug. 25, 2011

(51) Int. Cl.
*H01H 1/10* (2006.01)

(52) U.S. Cl. ..... 200/512

(58) Field of Classification Search ..... 200/512, 200/515–517, 302.1, 302.2
See application file for complete search history.

(56) References Cited

U.S. PATENT DOCUMENTS

| | | | | |
|---|---|---|---|---|
| 3,996,428 | A * | 12/1976 | Buan et al. | 200/5 A |
| 4,415,780 | A | 11/1983 | Daugherty | |
| 4,916,262 | A | 4/1990 | Jungels-Butler et al. | |
| 4,916,275 | A * | 4/1990 | Almond | 200/516 |
| 5,561,278 | A * | 10/1996 | Rutten | 200/5 A |
| 5,748,114 | A | 5/1998 | Koehn | |
| 6,191,776 | B1 * | 2/2001 | Hu | 345/168 |
| 6,603,086 | B2 | 8/2003 | Kawaguchi et al. | |
| 7,176,889 | B2 | 2/2007 | Baker et al. | |
| 2001/0035338 | A1 | 11/2001 | Liao | |
| 2006/0062624 | A1 | 3/2006 | Choi | |
| 2009/0078553 | A1 | 3/2009 | Sanford et al. | |
| 2009/0272639 | A1 | 11/2009 | Mittleman et al. | |

FOREIGN PATENT DOCUMENTS

| | | |
|---|---|---|
| WO | 9005373 | 5/1990 |

OTHER PUBLICATIONS

Extended European Search Report dated Jun. 2, 2010. In corresponding application No. 10154440.1.

* cited by examiner

*Primary Examiner* — Xuong Chung Trans
(74) *Attorney, Agent, or Firm* — Fitch, Even, Tabin & Flannery, LLP

(57) ABSTRACT

A keyboard dome stiffener assembly includes a circuit board having a plurality of dome pads that each defines a venting aperture, a dome sheet disposed over the circuit board, and a stiffener disposed beneath the circuit board that defines a plurality of cutouts corresponding to each venting aperture. The dome pads correspond to a key of an associated keyboard to be assembled with the keyboard dome stiffener assembly. The dome sheet forms an air space associated with each dome pad that is in fluid communication with the corresponding venting aperture. The cutouts of the stiffener provide an air cavity between the circuit board and the stiffener. Each air cavity is in fluid communication with an air space, and when one of the keyboard keys is depressed, some of the air in the air space travels between the air space of the keyboard to the corresponding air cavity.

18 Claims, 6 Drawing Sheets

KEYBOARD DOME STIFFENER ASSEMBLY

FIELD OF TECHNOLOGY

The present disclosure relates generally to mobile devices. More specifically, the present disclosure relates to keyboard assemblies for mobile devices.

BACKGROUND

With the advent of more robust electronic systems, advancements of mobile devices are becoming more prevalent. Mobile devices can provide a variety of functions including, for example, telephonic, audio/video, and gaming functions. Mobile devices can include cellular telephones, smart telephones, portable gaming systems, personal computers, portable MP3 players, electronic writing or typing tablets, handheld messaging devices, and portable computers.

Some mobile devices include switch panels such as keyboards and keypads. As the available functions of mobile devices continue to increase, the functionality of the switch panels also needs to increase. Because mobile devices often have limited space for switch panels, the size, tactile feedback, audible feedback, and life of the switch panel can be compromised to fit the switch panel on the mobile device. In smaller mobile devices, some switch panels require a very light force and very small deflection to actuate the individual keys of the switch panel. Without any type of feedback, operators can have difficulty sensing the switch closures, and thus can have difficulty in entering input using the switch panel. To address this, some switch panels have included dome switches that provide tactile feedback and audible feedback when the keys of the switch panel are actuated.

Typical dome switch panels include a circuit board panel having conductive traces separated by a non-conductive gap, where the conductive traces are arranged in a keyboard or a keypad array. The conductive traces correspond to each of the keys of the keyboard or keypad array. A flexible dome is provided above each of the conductive traces. When a key of the switch panel is depressed, the flexible dome is compressed towards the circuit board panel and closes the conductive trace, thereby closing the switch to enter input to the mobile device. When pressure or force is removed from the key, the flexible dome returns to its original shape, provides a gap between the conductive traces, and opens the switch. The flexibility and deflection of the dome can provide tactile feedback and audible feedback to indicate a switch has been closed, which also indicates input has been entered to the mobile device.

BRIEF DESCRIPTION OF THE DRAWINGS

Embodiments of the present application will now be described, by way of example only, with reference to the attached Figures, wherein.

DETAILED DESCRIPTION

Figure 1:
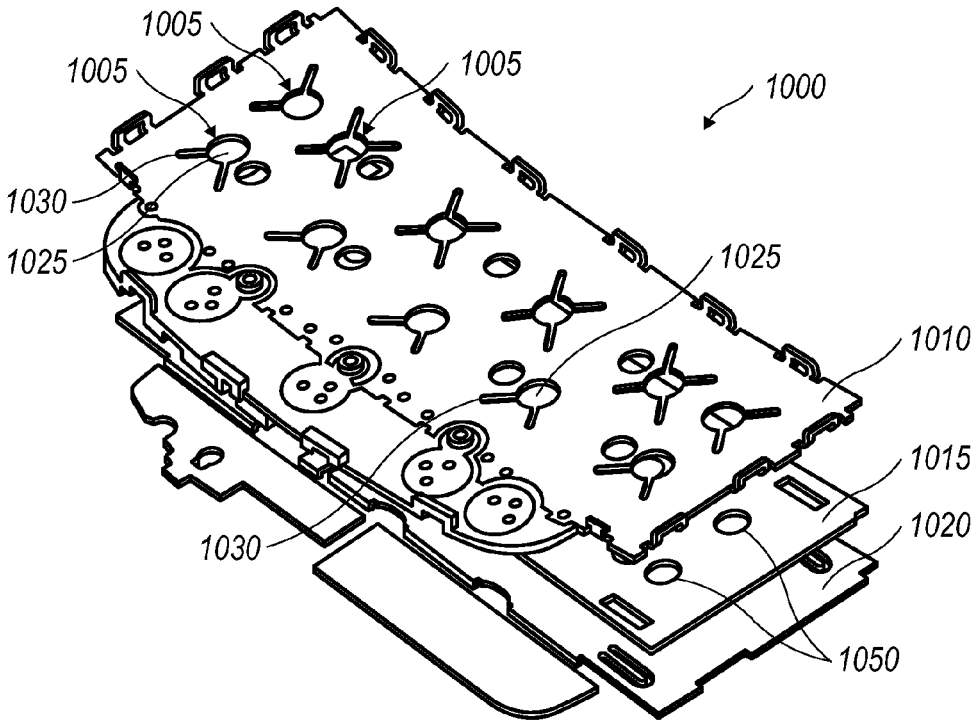
FIG. 1 is a exploded view of a stiffener of an exemplary keyboard dome stiffener assembly in accordance with an exemplary embodiment.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures and components have not been described in detail so as not to obscure the related relevant feature being described. Also, the description is not to be considered as limiting the scope of the embodiments described herein.

In some traditional mobile devices, the keyboard includes a dome sheet having slits or vents to vent air from within the switch panel. By venting the keyboard, air can move within the dome sheet to alter the flexibility or deflection of the dome switch domes. However, dust, moisture, or manufacturing debris can enter the slits or vents thereby dirtying or corroding the switch panel and the circuit board. In other traditional keyboards, adhesive layers and composite structures can be incorporated with the keyboard to hermetically seal the dome switches to prevent dust and moisture from dirtying the switch and circuit board. The additional layers and structures can increase the rigidity of the dome switches and the key, which can affect tactile and audible feedback provided to the user. The less feedback given to the user to indicate successful switch closure and input entry, the more difficulty and frustration the user can have in actuating the switch panel. To address these problems of conventional keyboards, the following figures and description describe a keyboard dome stiffener assembly for better tactile feel. While the following description describes a keyboard dome stiffener assembly for a handheld mobile communication device, one of ordinary skill in the art will appreciate that the keyboard dome stiffener assembly can be implemented with a standard computer keyboard, a portable computing device, a laptop, a personal digital assistant (PDA), a video game controller, a walkie-talkie, or any other mobile device that utilizes a switch panel, a keyboard, or a keypad.

A keyboard dome stiffener assembly includes a circuit board, a dome sheet disposed over the circuit board, and a stiffener disposed beneath the circuit board. The circuit board has a plurality of dome pads that each corresponds to a key of a keyboard to which the dome stiffener assembly will be assembled. Each dome pad can define a venting aperture. The dome sheet forms an air space associated with each dome pad and venting aperture. The stiffener defines a plurality of cutouts which can provide an air cavity between the circuit board and the stiffener. Each air cavity is in fluid communication with at least one air space, and when one of the keyboard keys is depressed, a portion of air travels from the air space associated with the keyboard key to the corresponding air cavity. The assembly and configuration of the circuit board, dome sheet, stiffener, and the air spaces and air cavities defined therein allow for enhanced tactile feedback when the keyboard keys are actuated. Additional components, such as spacers and adhesive dots can be included in the keyboard dome stiffener assembly to further enhance the tactile feedback of the associated keyboard. Other configurations and arrangements will be described below in relation to illustrated embodiments. One of ordinary skill would appreciate that the elements from the illustrated embodiments can be optionally included and arranged in various combinations to achieve the described benefits of the presently disclosed keyboard dome stiffener assembly.

Referring to FIG. 1, at least one embodiment of an exemplary embodiment of a stiffener or stiffener sheet 1000 for a keyboard dome stiffener assembly is illustrated in an exploded view. The stiffener 1000 can comprise three layers: a top layer 1010, a bottom layer 1020, and an adhesive or middle layer 1015 interposed between the top layer 1010 and the bottom layer 1020. The top layer 1010 can define a plurality of cutouts 1005. The plurality of cutouts 1005 provide an air cavity (not shown) between the bottom layer 1020 of the stiffener 1000 and a circuit board to which the stiffener 1000 will be coupled. In at least the embodiment illustrated in FIG. 1, each cutout 1005 comprises a center cutout 1025 and at least one air channel 1030 extending radially from the center cutout 1025. In FIG. 1, each center cutout 1025 comprises at least two air channels 1030 extending radially therefrom. Each air channel 1030 corresponds to a key of the keyboard to which the keyboard dome stiffener assembly will be assembled. As shown in FIG. 1, there are thirty air channels 1030 corresponding to thirty keys of a keyboard having at least twenty-six keys with an alphabetic character. However, one of ordinary skill in the art will appreciate that the stiffener 1000 can have fewer or more than two air channels 1030, depending on the number of keys of the associated keyboard. For example, in alternative embodiments, the stiffener 1000 can have nine air channels corresponding to nine keyboard keys, twenty four air channels, thirty five air channels, twenty air channels, or any other number of air channels that corresponds to the number of depressible keys of the associated keyboard. For example, the stiffener 1000 can have twenty air channels corresponding to the twenty keys of a reduced QWERTY keyboard. Additionally, the air channels 1030 can correspond to depressible keys of the keyboard other than the alphanumeric keys. For example, the air channels 1030 can correspond to a volume key, a menu key, a mute button, a function button, or any other depressible button or key of the associated keyboard.

As seen in FIG. 1, the middle layer 1015 is disposed beneath the top layer 1010 which defines the plurality of cutouts 1005 of the stiffener 1000. The middle layer 1015 can be an adhesive layer, such as SN7103, double-sided tape, adhesive tape, a layer of epoxy, or any other type of adhesive. The middle layer 1015 can include an adhesive cutout 1050 corresponding to each cutout 1005 of the top layer 1010. In the particular embodiment illustrated in FIG. 1, each adhesive cutout 1050 corresponds to the center cutout 1025 of the cutout 1005. The bottom layer 1020 can be disposed beneath the adhesive layer 1015, thereby sealing the cutouts 1005 of the stiffener 1000. Thus, when the associated circuit board (not shown) is coupled to the top of the top layer 1010 of the stiffener 1000, an air cavity 1035 (shown in FIG. 6) will be formed between the circuit board (not shown) and the bottom layer 1020 of the stiffener 1000. Also, with respect to the particular embodiment illustrated in FIG. 1, the adhesive layer 1015 can seal the air channels 1030 that extend radially from the center cutouts 1025. Thus, the center cutout 1025 provides the air cavity 1035 between the stiffener 1000 and the circuit board 2000 (not shown) to be assembled to the stiffener 1000. Also, air channel 1030 can fluidly couple the center cutout 1025 and air cavity 1035 with a venting aperture (not shown) of the circuit board (not shown).

Figure 2:
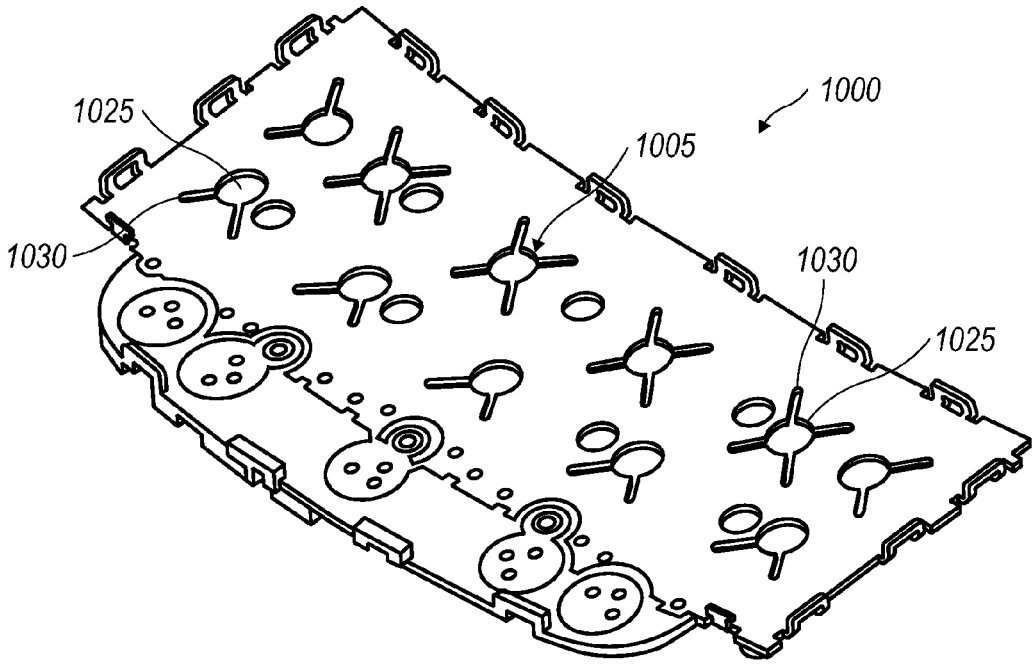
FIG. 2 is a perspective view of the stiffener of the exemplary keyboard dome stiffener assembly depicted in FIG. 1 in an assembled configuration.

FIG. 2 is a perspective view of the exemplary stiffener of FIG. 1 in an assembled configuration. While the exemplary embodiment illustrated in FIGS. 1 and 2 depict a stiffener 1000 comprising three layers, one of ordinary skill in the art will appreciate that the stiffener 1000 can comprise fewer than or more than three layers. For example, in at least one embodiment, the stiffener 1000 can be a single integrated structure having the plurality of cutouts 1000 removed during manufacturing such that the bottom surface of the stiffener 1000 seals the cutouts 1000. In another exemplary embodiment, the stiffener 1000 can include a fourth layer, such as a spacer or another adhesive, interposed between the top layer 1010 and the bottom layer 1020. In other embodiments, the stiffener 1000 can have more than four layers.

The stiffener 1000 can be made from any material that provides rigidity to an associated keyboard that will be assembled to the keyboard dome stiffener assembly. For example, the stiffener 1000 can be made from rigid plastic, rubber, or metal. FIGS. 1 and 2 illustrate a stiffener 1000 made of metal. Specifically, FIG. 1 illustrates at least one embodiment of the stiffener 1000 having the top layer 1010 and the bottom layer 1020 both made of metal that are bonded together by the adhesive layer 1015. In one embodiment, the top layer 1010 can be made of SS-301 stainless steel, and the bottom layer can be made of SS-304 stainless steel. In at least one other embodiment, the top layer 1010 and the bottom layer 1020 can be made of cold-roll steel or any other type of metal sheet. While the illustrated embodiment shows the top layer 1010 and the bottom layer 1020 made of two different types of metal, one of ordinary skill in the art will appreciate that the top layer 1010 and the bottom layer 1020 can be made of the same type of metal. In other embodiments of the stiffener 1000 having multiple layers, each layer can be made of a material different from the other layers.

Additionally, the stiffener 1000 can have a thickness of 0.40 millimeters, 0.50 millimeters, 0.30 millimeters, or any other thickness that allows the stiffener to fit in a mobile device comprising the keyboard dome stiffener assembly. For example, in the illustrated embodiment of FIG. 1, the top layer 1010 can have a thickness of 0.25 millimeters, the bottom layer 1020 can have a thickness of 0.12 millimeters, and the adhesive layer 1015 can have a thickness of 0.03 millimeters. However, one of ordinary skill in the art will appreciate that the thickness of the multiple layers of the stiffener 1000 can vary so long as the stiffener 1000 has an overall thickness that permits the stiffener 1000 to fit in the corresponding mobile device.

Figure 3:
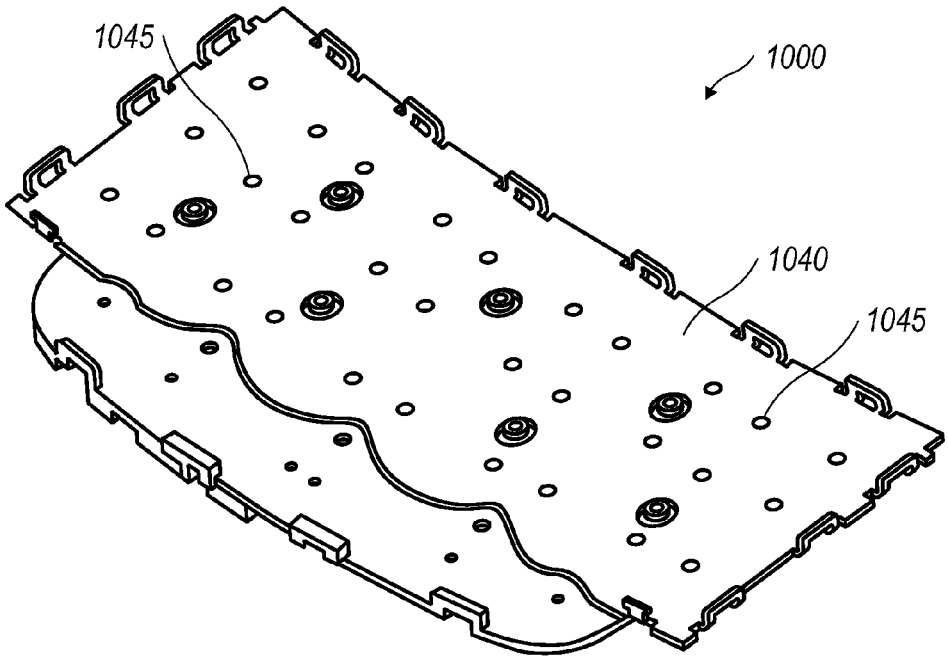
FIG. 3 is a perspective view of the stiffener of the exemplary keyboard dome stiffener assembly depicted in FIG. 1 in accordance with an exemplary embodiment including an adhesive layer.

FIG. 3 is a perspective view of the stiffener depicted in FIG. 1 in accordance with an exemplary embodiment including a top adhesive layer 1040 disposed on top of the stiffener 1000. The top adhesive layer 1040 couples the associated circuit board (not shown) to the stiffener 1000, and can define a plurality of openings 1045. Each opening 1045 corresponds to a venting aperture (not shown) of the associated keyboard (not shown). Each opening 1045 also corresponds to at least one of the cutouts 1005 of the stiffener 1000. For example, each opening 1045 can correspond to one of the air channels 1030 of the stiffener 1000. Referring to FIG. 2, each opening 1045 of the top adhesive layer 1040 can correspond to the distal ends of each of the air channels 1030, the distal end being the end farthest from the center cutout 1025. The top adhesive layer 1040 can provide the upper boundary of the air cavity 1035 that is formed between the circuit board (not shown) and the bottom surface or bottom layer 1020 of the stiffener 1000. Thus, the air cavity 1035 is bound by the top adhesive layer 1040 and the bottom layer 1020 of the stiffener 1000. Additionally, the top adhesive layer 1040 can provide the top boundary of the air channels 1030 of the stiffener 1000. Thus, the air channels 1030 can be bound by the middle layer 1015 and the top adhesive layer 1040 when the keyboard dome stiffener assembly is assembled. Consequently, air can travel through the opening 1045 of the top adhesive layer 1040 through the air channel 1030 to the center cutout 1025 which provides the air cavity 1035. Thus, air can move between the space above the top adhesive layer 1040 and the air cavity 1035 between the top adhesive layer 1040 and the stiffener 1000.

Figure 4:
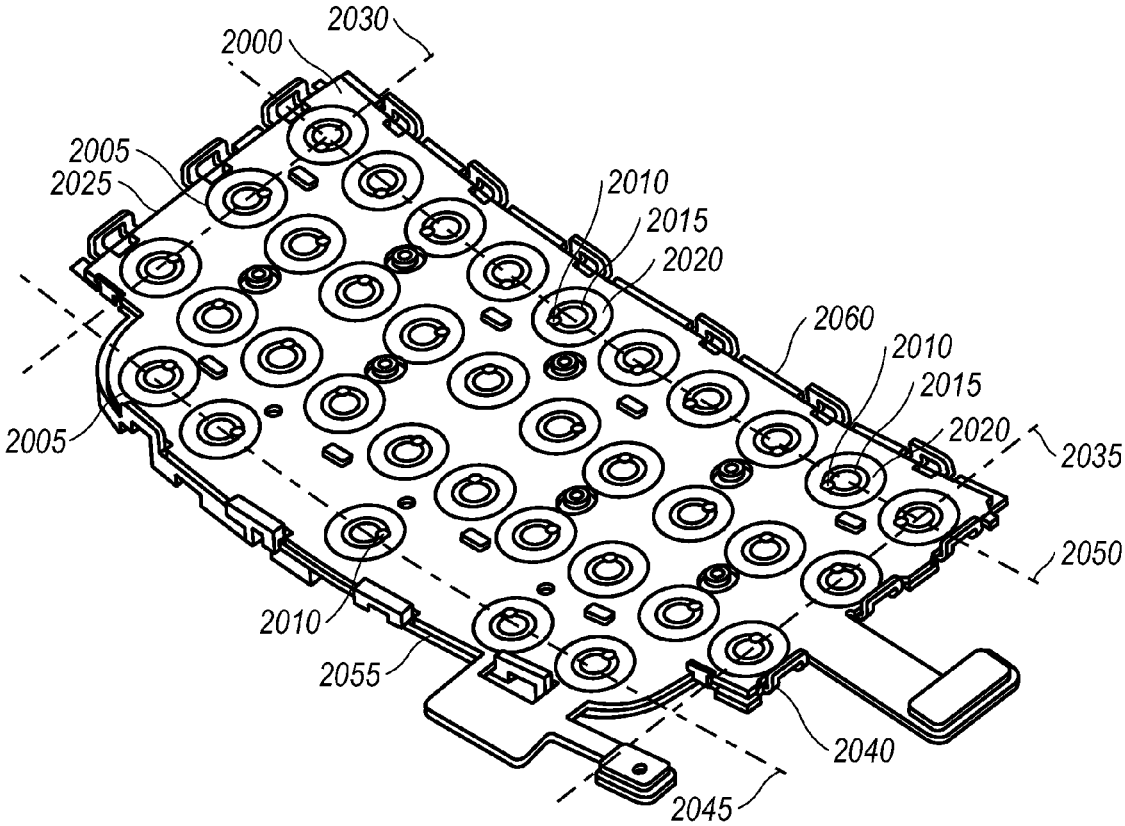
FIG. 4 is a perspective view of the stiffener of the exemplary keyboard dome stiffener assembly depicted in FIG. 1 in accordance with an exemplary embodiment including a circuit board.

FIG. 4 is a perspective view of the stiffener depicted in FIG. 1 in accordance with an exemplary embodiment including a circuit board 2000. The circuit board 2000 can be a printed circuit board (PCB), a printed circuit assembly (PCA), a flexible printed circuit (FPC), a wiring board, or any other circuit board. The circuit board 2000 can have a thickness that permits the circuit board 2000 to fit in the associated mobile device that the keyboard dome stiffener assembly will be assembled to. For example, the circuit board 2000 can have a thickness of 0.15 millimeters, 0.22 millimeters, 0.12 millimeters, 0.10 millimeters, 0.50 millimeters, or any other thickness that permits the circuit board 2000 to fit in an associated mobile device.

In at least one embodiment, as illustrated in FIG. 4, the circuit board 2000 can include a plurality of dome pads 2005. Each dome pad 2005 corresponds to a key of the associated keyboard to which the keyboard dome stiffener assembly will be assembled. For example, each dome pad 2005 can provide the mobile circuitry for the corresponding keyboard key to input data into the mobile device when the keyboard key is pressed, compressed, depressed, or actuated. For example, each dome pad 2005 can correspond to the keys of a full text-entry keyboard, such as a QWERTY, QWERTZ, AZERTY, Dvorak, or any other standard text-entry keyboard. In the particular embodiment illustrated in FIG. 4, there are thirty-five dome pads 2005. In other embodiments, where a reduced keyboard is implemented, such as a reduced QWERTY, reduced QWERTZ, or reduced AZERTY keyboard, the number of keycaps and corresponding dome-shaped overlays is reduced compared to that shown in the illustration. For example, only twenty dome pads 2005 can be implemented with a reduced QWERTY keyboard. Still further, one of ordinary skill in the art will appreciate that the number of dome pads 2005 implemented in the keyboard dome stiffener assembly can be greater than or less than the thirty-five dome pads 2005 illustrated as desired for the particular configuration of the keys of the keyboard. In at least one alternative embodiment, the dome pads 2005 can correspond to any depressible key or button of the corresponding keyboard to be assembled with the keyboard dome stiffener assembly. For example, the dome pad 2005 can correspond to a volume key, a menu key, a mute button, a function button, or any other depressible button or key of a keyboard.

The dome pads 2005 can include plated pads, which can be disposed on a top surface of the circuit board 2000 and can provide the circuitry that transmits input to the associated mobile device. The plated pads of the dome pad 2005 can be gold plated pads, but persons of ordinary skill in the art will appreciate that the plated pads can also be copper plated pads or any other plated pad that facilitates transmittal of input to the mobile device when the keys of the associated keyboard are depressed or actuated and come in contact with the dome pads 2005.

Additionally, each dome pad 2005 defines a venting aperture 2010 through which air can pass when the corresponding keyboard key is pressed, depressed, compressed, or actuated. In the particular embodiment illustrated in FIG. 4, the dome pad 2005 can include an inner trace 2015 and an outer trace 2020. In at least one embodiment, the venting aperture 2010 is defined between the inner trace 2015 and the outer trace 2020. In an alternative embodiment, the venting aperture 2005 can be defined in the inner trace 2015, in the outer trace 2020, or in the center of the dome pad 2005. In other alternative embodiments, the dome pads 2005 need not include an inner trace and an outer trace and can be a solid or uniform dome pad 2005. While the illustrated embodiments depict a dome pad 2005 that is circular in shape, in alternative embodiments, the dome pads 2005 can be any other shape, such as square, ovular, diamond, polygonal, or any other shape.

In at least one embodiment, the venting apertures 2010 can be defined by the dome pad 2005 at locations that provide an enhanced seal when a dome sheet is assembled on top of the circuit board 2000. For example, in at least one embodiment, as illustrated in FIG. 4, the dome pads 2005 located proximate to the side edges 2025, 2040 of the circuit board 2000 can define venting apertures 2010 on the side of the dome pad 2005 that is farthest away from the side edge 2025, 2040 of the circuit board 2000. In FIG. 4, the dome pads 2005 are circular in shape, and the venting aperture 2010 can be defined on the side of the longitudinal centerline 2030, 2035 of the dome pad 2005 that is farthest from the side edge 2025, 2040 of the circuit board 2000. In other words, for the dome pads 2005 proximate to the left side edge 2025 of the circuit board 2000, the venting aperture 2010 can be defined on the right hemisphere of the dome pad 2005 located to the right of the longitudinal centerline 2030 of the dome pad 2005. Similarly, for the dome pads 2005 proximate to the right side edge 2040 of the circuit board 2000, the venting aperture 2010 is defined on the left hemisphere of the dome pad 2005 located to the left of the longitudinal centerline 2035 of the dome pad 2005. By forming the venting apertures 2010 of the dome pads 2005 proximate to the side edges 2025, 2040 of the circuit board 2000 at locations away from the side edges 2025, 2040, the dome pads 2005 can have an enhanced seal when the circuit board 2000 is assembled with an associated dome sheet 3000 (shown in FIG. 5) and an associated keyboard. For example, the venting apertures 2010 of the dome pads 2005 proximate the side edges 2025, 2040 of the circuit board will be sealed off from any dust, moisture, corrosion, debris or other dirt that might dirty the dome pad 2005 and clog the venting aperture 2010. The venting apertures 2010 are formed away from the seal that will be made between the side edges 2025, 2040 of the circuit board 2000 with the associated dome sheet or the associated keyboard.

Further, the dome pads 2005 located proximate to the bottom edge of the 2055 of circuit board 2000 can define venting apertures 2010 on the side of the dome pad 2005 that is farthest away from the bottom edge 2055 of the circuit board 2000. In FIG. 4, the dome pads 2005 are circular in shape, and the venting aperture 2010 is defined on the side of the lateral centerline 2045 of the dome pad 2005 that is farthest from the bottom edge 2055 of the circuit board 2000. In other words, for the dome pads 2005 proximate to the bottom edge 2055 of the circuit board 2000, the venting aperture 2010 is defined in the top hemisphere of the dome pad 2005 located above the lateral centerline 2045 of the dome pad 2005. Similarly, for the dome pads 2005 proximate to a top edge 2060 of the circuit board 2000, the venting aperture 2010 is defined on the bottom hemisphere of the dome pad 2005 below a lateral line 2050 of the dome pad 2005. By forming the venting apertures 2010 of the dome pads 2005 proximate to the bottom edge 2055 and the top edge 2060 of the circuit board 2000 at locations away from the bottom edge 2055 and the top edge 2060, the dome pads 2005 can have an enhanced seal when the circuit board 2000 is assembled with an associated dome sheet 3000 (shown in FIG. 5) and an associated keyboard. For example, the venting apertures 2010 of the dome pads 2005 proximate to the bottom edge 2055 of the circuit board and the dome pads 2005 proximate to the top edge 2060 of the circuit board 2005 will be sealed off from any dust, moisture, corrosion, debris or other dirt that might dirty the dome pad 2005 and clog the venting aperture 2010. The venting apertures 2010 are formed away from the seal that will be made between the side edges of the circuit board 2000 and the associated dome sheet or the associated keyboard.

The exemplary embodiment of the circuit board 2000 illustrated in FIG. 4 is coupled above the stiffener 1000 (illustrated in FIG. 1) by the adhesive layer 1040 (illustrated in FIG. 3). In an alternative embodiment, the circuit board 2000 can be coupled above the stiffener 1000 by hooks and fasteners, by a soldered joint, by adhesive tabs, or by any other coupling that secures the circuit board 2000 to the stiffener 1000.

Figure 5:
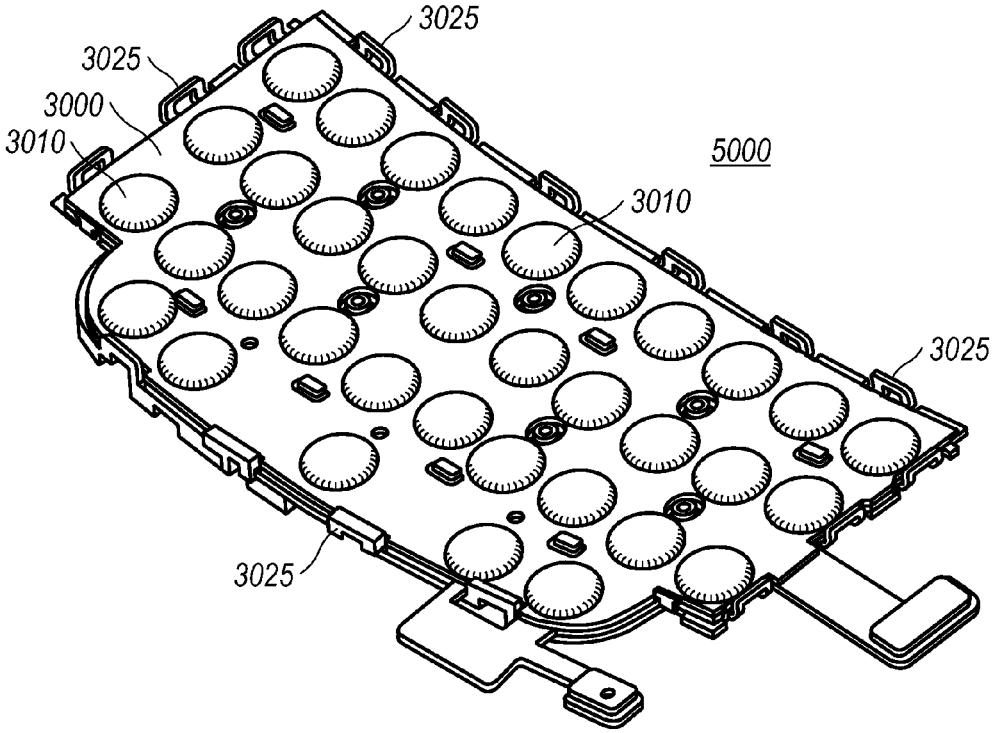
FIG. 5 is a perspective view of an exemplary embodiment including a dome sheet.

FIG. 5 is a perspective view of an exemplary embodiment including the dome sheet 3000 disposed over the circuit board. The dome sheet 3000 can form an air space 3005 (shown in FIG. 7) associated with each dome pad 2005 when assembled with the circuit board 2000. In at least one embodiment, as depicted in FIG. 5, the dome sheet 3000 comprises a plurality of dome-shaped overlays 3010. Each dome-shaped overlay 3010 corresponds to a key of the associated keyboard to be assembled with the keyboard dome stiffener assembly. When the dome sheet 3000 is assembled on top of the circuit board 2000, which is assembled on top of the stiffener 1000, the dome-shaped overlays 3010 are positioned over each dome pad 2005 of the circuit board 2000. In the illustrated embodiment of FIG. 5, each dome-shaped overlay 3010 forms an air space (not shown) associated with a corresponding dome pad 2005. Each dome-shaped overlay 3010 can correspond to a keycap of a keyboard to which the keyboard dome stiffener assembly will be assembled. For example, the dome-shaped overlays 3010 can correspond to the keycaps of a full text-entry keyboard, such as a QWERTY, QWERTZ, AZERTY, Dvorak, or any other standard text-entry keyboard. In the particular embodiment illustrated in FIG. 5, there are thirty-five dome-shaped overlays 3010. In other embodiments, where a reduced keyboard is implemented, the number of keycaps and corresponding dome-shaped overlays 3010 is reduced compared to that shown in the illustration. For example, only twenty dome-shaped overlays 3010 can be implemented in a reduced QWERTY keyboard. Still further, one of ordinary skill in the art will appreciate that the number of dome-shaped overlays 3010 implemented in keyboard dome stiffener assembly can be greater than or less than the thirty-five dome-shaped overlays 3010 illustrated as desired for the particular configuration of the keys of the keyboard. In at least one alternative embodiment, the dome-shaped overlays 3010 can correspond to any depressible key or button of the corresponding keyboard to be assembled with the keyboard dome stiffener assembly. For example, the dome-shaped overlay 3010 can correspond to a volume key, a menu key, a mute button, a function button, or any other depressible button or key of a keyboard. While the illustrated embodiment shows a dome sheet 3000 comprising a plurality of dome-shaped overlays 3010, one of ordinary skill will appreciate that the dome sheet 3000 can be a flat dome sheet that can be implemented into a membrane keyboard, a flat panel keyboard, a capacitive keyboard, or any other type of keyboard that does not require keycaps, individual buttons, or chiclet-type keycaps.

The keyboard dome stiffener assembly 5000 can include a plurality of hooks 3025, as illustrated in FIG. 5. An associated keyboard light guide or keyboard keycap layer of an associated keyboard can be secured to the keyboard dome stiffener assembly 5000 by the plurality of hooks 3025. For example, in one embodiment, the keyboard light guide of the keyboard key cap layer can be clamped to the plurality of hooks 3025. However, one of ordinary skill in the art will appreciate that the keyboard light guide or the key cap layer can be secured to the keyboard dome stiffener assembly 5000 by any other means. For example, the light guide or key cap layer can be adhered to, screwed on, bolted, soldered, or secured by any other means to the keyboard dome stiffener assembly 5000.

Figure 6:
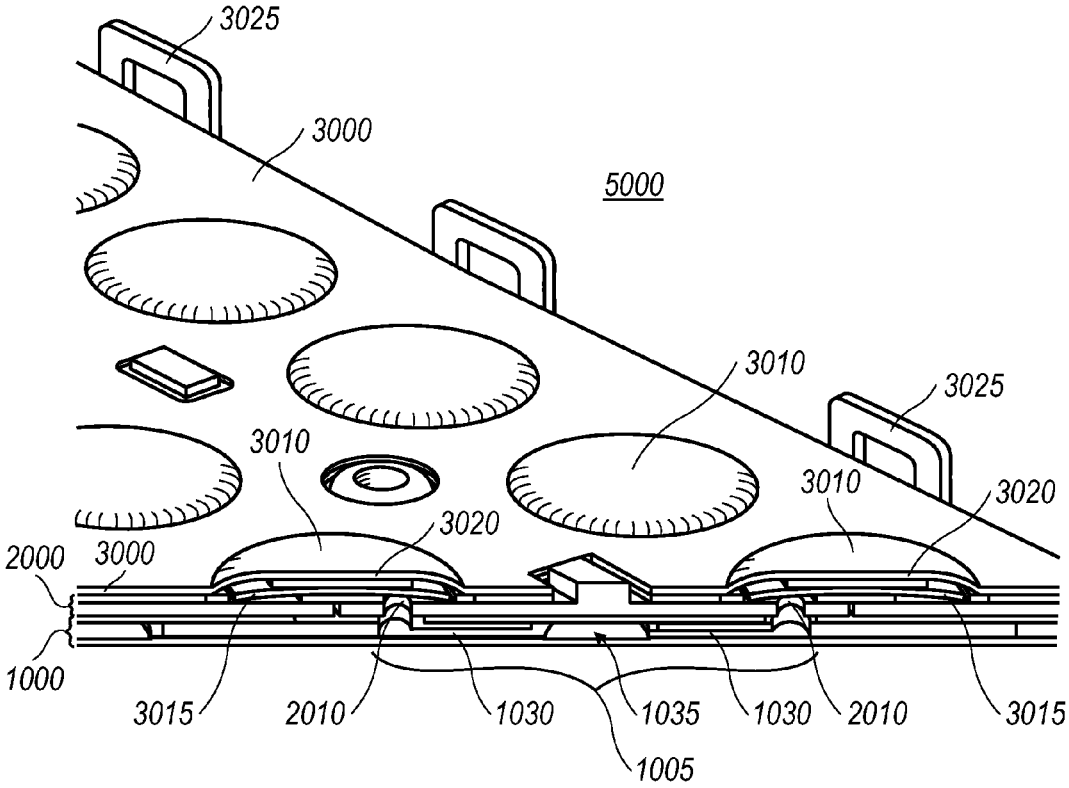
FIG. 6 is a side elevation view of the exemplary keyboard dome stiffener assembly depicted in FIG. 5 showing the cross-section of two dome switches.
Figure 7:
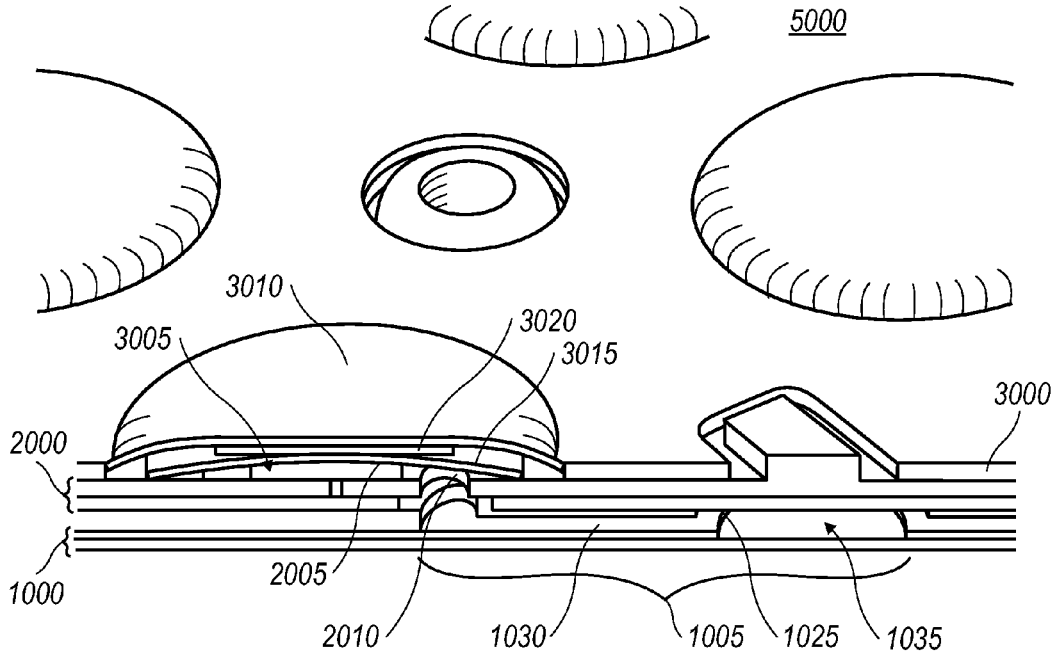
FIG. 7 is a front elevation view of the exemplary keyboard dome stiffener assembly depicted in FIG. 6 showing the cross-section of one of the dome switches.
Figure 8:
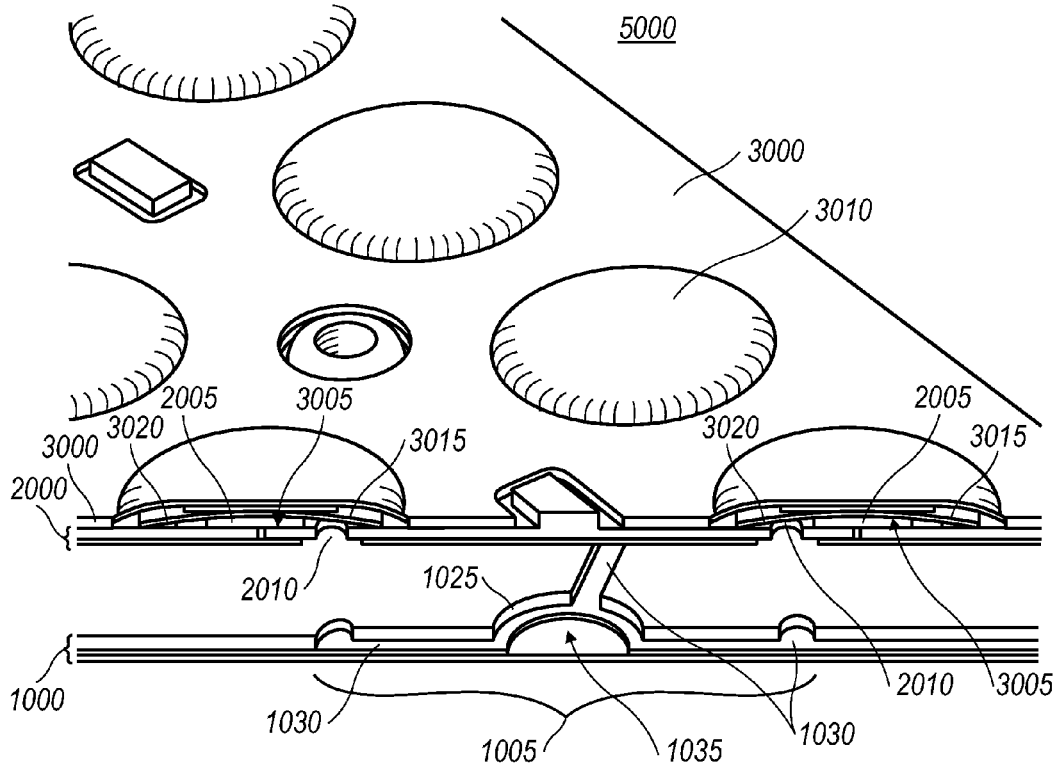
FIG. 8 is an exploded elevation view of the exemplary keyboard dome stiffener assembly depicted in FIG. 5.

The configuration and fluid communication between the stiffener 1000, circuit board 2000, and dome sheet 3000 will be discussed in the following paragraphs with respect to FIGS. 6-8. FIG. 6 is a side elevation view of the exemplary keyboard dome stiffener assembly 5000 showing the cross-section of the layers of the dome stiffener assembly. FIG. 7 is a close-up view of one of the dome pads 2005 of the keyboard dome stiffener assembly 5000 illustrated in FIG. 6. FIG. 8 is a partially exploded view of the exemplary keyboard dome stiffener assembly 5000 illustrated in FIG. 6 showing the alignment between the stiffener 1000 and the circuit board 2000. As illustrated in FIG. 6-8, the circuit board 2000 is disposed beneath the dome sheet 3000 and disposed on top of the stiffener 1000. A plurality of dome switches 3015 can be disposed between the dome sheet 3000 and the circuit board 2000. Each dome switch 3015 is associated with a corresponding dome pad 2005 of the circuit board 2000 and can be electrically coupled to the dome pad 2005 to input data entered by actuations of the associated keyboard keys. The dome switch 3015 can be, but does not necessarily have to be, held in place by an adhesive dab 3020 as illustrated in FIGS. 6-8.

When the stiffener 1000, circuit board 2000, and dome sheet 3000 are assembled, the venting apertures 2010 of the circuit board 2000 align with the cutouts 1005 of the stiffener 3000. In at least the illustrated embodiment of FIGS. 6-9, the cutouts 1005 comprise a center cutout 1025 and air channels 1030 extending radially outward from the center cutout 1025. The venting apertures 2010 align with the air channels 1030 of the stiffener 1000. The air cavity 1035 is provided by the center cutout 1025 of the stiffener 1000 and is bounded by the bottom surface of the top layer adhesive 1040 and the top surface of the bottom layer 1020 of the stiffener 1000. When the keyboard dome stiffener assembly 5000 is assembled, the venting apertures 2010 are in fluid communication with the air cavity 1035 via the cutouts 1005 of the stiffener 1000. Also in the assembled configuration, the dome sheet 3000 forms an air space 3005 associated with the dome pad 2005, and consequently associated with the venting aperture 2010 of the circuit board 2000. The air space 3005 and the air cavity 1035 are in fluid communication with each other via the venting aperture 2010 and the cutout 1005 of the stiffener 1000. Thus, some air from the air space 3005 can travel through the venting aperture 2010, through the air channel 1030 of the cutout 1005 and into the air cavity 1035 provided by the center cutout 1025 of the stiffener, and vice versa.

In the particular embodiments illustrated in FIGS. 6-8, the dome-shaped overlay 3010 and dome switch 3015 can form the air space 3005 above the dome pad 2005 and corresponding venting aperture 2010. When the dome-shaped overlay 3010 and the dome switch 3015 are depressed, compressed, or otherwise actuated, some of the air in the air space 3005 between the dome switch 3015 and the dome pad 2005 is forced through the venting aperture 2010. The air can then move from the venting aperture 2010 through the cutout 1005 via the air channel 1030 and into the air cavity 1035. Referring to FIGS. 7 and 8, when the dome sheet 3000, circuit board 2000, and the stiffener 1000 are assembled, in at least one embodiment, the cutouts 1005 of the stiffener 1000 are sealed by the circuit board 2000, and only the venting apertures 2010 of the circuit board 2000 are exposed to the air space 3005 between the dome sheet 3000 and the dome pad 2005. That the venting apertures 2010 are the only apertures exposed to the air space 3005 ensures enhanced water and dust protection. Additionally, the configuration of the dome sheet 3000, circuit board 2000, and stiffener 1000 ensures that the portions of air traveling between the air space 3005 and the air cavity 1035 will only travel between the venting apertures 2010 and cutouts 1005 and will not escape elsewhere in the keyboard or mobile device. Additionally, the configuration of the dome sheet 3000, circuit board 2000, and stiffener 1000 ensures that the controlled movement of air from the air space 3005 and the air cavity 1035 provides an enhanced tactile feedback that a user is typically accustomed to in larger conventional dome switch keyboards. For example, the present disclosure provides an enhanced click or snap feeling upon depression of the dome switch in comparison to similar sized traditional dome switches.

Referring to FIG. 8, in at least one embodiment a cutout 1005 of the stiffener 1000 can have more than one air channel 1030 extending radially from the center cutout 1025. As seen in FIG. 8, the center cutout 1025 has three air channels 1030 that are each associated with a venting aperture 2010, dome switch 3015, and dome shaped overlay 3010. Thus, each air channel 1030 is associated with one dome switch 3015 and its associated keyboard key. In the embodiment illustrated in FIG. 8, there are fewer center cutouts 1025 than there are air channels 1030. For each associated depressible keyboard key or button there is a corresponding air channel 1030 that is associated with a center cutout 1025 and an air cavity 1035. As each key and corresponding dome switch 3015 illustrated in FIG. 8 is depressed, some of the air in the air space 3005 beneath the dome switch 3015 will only travel through the associated venting aperture 2010 into the associated air channel 1030 and finally into the air cavity 1035. The implementation of a single air channel 1030 for each dome switch controls the movement of air to provide enhanced tactile feedback, such as a click feel or a snap feel, when a user depresses a key on the associated keyboard having the disclosed keyboard dome stiffener assembly 5000. The air in the air spaces 3005 is limited to movement between their corresponding air cavity 1035 and any other air spaces 3005 fluidly coupled to the air cavity 1035. As a result, an amount of air can be vented from beneath the dome switch 3015 or beneath the dome sheet 3000 and can return to the air space 3005 beneath the dome switch 3015 each time a keyboard key is actuated and unactuated, thereby providing tactile feedback to the user.

The configuration of the dome sheet 3000, the venting apertures 2010 of the circuit board 2000, and the cutouts 1005 of the stiffener 1000 define the air spaces 3005 and the air cavities 1035. As a result the keyboard dome stiffener assembly 5000 controls the passage of air thereby providing an enhanced tactile feedback to the user when a keyboard key is pressed into an actuated and unactuated position. When a key is pressed into the actuated position, some of the air in the air space 3005 is vented or forced through the venting aperture 2010 and the cutouts 1005. As a result, the resistance required to depress the keyboard key is lessened, allowing for greater deflection of the keyboard key's dome switch 3015. The deflection of the dome switch 3015 can provide the firm tactile feedback, such as a click feel. Then, when the key is released back into the unactuated position, the air that was pushed into the air cavity 1035 is pushed back through the cutouts 1005 and the venting aperture 2010 and back into the air space 3005. The movement of air between the air space 3005 and the air cavity 1035 provides a tactile feedback to the user which can inform the user that the keyboard key has been successfully and completely pressed or actuated.

The configuration of the stiffener 1000, circuit board 2000, and dome sheet 3000 can also provide additional rigidity to the associated keyboard when a key is pressed into the actuated configuration. As a key of the keyboard and its corresponding dome switch 3015 are depressed, the user will contact the top surface of the stiffener 1000 thereby providing a firm rigid tactile feedback.

The tactile difference between the unactuated and actuated positions of the keyboard key provides a firmer tactile feedback to a user as compared to a configuration without the keyboard dome stiffener assembly 5000. Additionally, as a result of the air spaces 3005 and air cavities 1035 defined by the keyboard dome stiffener assembly 5000, the keyboard key can accommodate greater deflection when the keyboard key is compressed, depressed, or actuated prior to providing a tactile feedback. With the extra deflection in the keyboard key, the user can experience enhanced tactile feedback, thereby indicating that the keyboard key has been successfully actuated to close the circuit of the circuit board 2000 and to input data into the mobile device associated with the keyboard dome stiffener assembly 5000.

In an alternative embodiment (not shown), the keyboard dome stiffener assembly 5000 can further comprise a spacer interposed between the dome sheet 3000 and the circuit board 2000. The keyboard dome stiffener assembly 5000 can also include layers of double-sided tape or layers of adhesive interposed between the dome sheet 3000, circuit board 2000, and stiffener 1000. In other alternative embodiments, other structural layers can be implemented that can enhance the rigidity of the stiffener 1000, enhance the tactile feedback of the keyboard, or can ensure the proper alignment of the dome sheet 3000, circuit board 2000, and stiffener 1000 to define the air cavities 1035 and air spaces 3005 of the keyboard dome stiffener assembly 5000.

Referring to FIGS. 7-8 as an example, a method of constructing a mobile device having the keyboard dome stiffener assembly 1000 as described in any of the embodiments described herein can include: forming a venting aperture 2010 within each dome pad 2005 of the circuit board 2000, forming a plurality of cutouts 1005 on the stiffener sheet 1000, coupling the stiffener sheet 1000 to the circuit board 2000, and coupling the dome sheet 3000 to the side of the circuit board 2000 opposite to the stiffener sheet 1000. The cutouts 1005 of the stiffener sheet 1000 are formed to correspond to at least one of the venting apertures 2010 of the circuit board 2000. The stiffener sheet 1000 is coupled to the circuit board 2000 such that the plurality of cutouts 1005 are aligned with its corresponding venting aperture 2010 to form the air cavity 1035 between the stiffener sheet 1000 and the circuit board 2000. The dome sheet 3000 is coupled to the top of the circuit board 2000 such that the air space 3005 is formed above each dome pad 2005 and such that each air cavity 1035 is in fluid communication with at least one of the air spaces 3005 formed above each dome pad 2005. The dome sheet 3000 can also be assembled with the circuit board 2000 and the stiffener sheet 1000 such that the venting apertures 2010 of the circuit board 2000 are exposed to the air space 3005 between the dome pads 2005 and the dome sheet 3000.

Forming the cutouts 1005 can be accomplished by stamping out the cutouts 1005 from a solid flat stiffener sheet. However, one of ordinary skill will appreciate that forming the cutouts 10005 can also be accomplished by laser cutting the cutouts 1005 from a solid flat stiffener sheet or die-cutting the cutouts 1005 from a solid flat stiffener sheet.

Forming the cutouts 1005 on the stiffener sheet 1000 can include forming the center cutout 1025 and at least one air channel 1030 extending radially from the center cutout 1025. The air channels 1030 on the stiffener sheet 1000 can be formed such that each venting aperture 2010 of the circuit board 2000 corresponds to one of the air channels 1030, thereby fluidly coupling the venting aperture 2010 to the center cutout 1025, which provides the air cavity 1035 between the circuit board 2000 and the stiffener sheet 1000.

The method of constructing the keyboard dome stiffener assembly 5000 can include coupling the adhesive layer 1015 to the rear surface of the stiffener sheet 1000 to seal the air channels 1030 of the stiffener sheet 1000. The method can also include coupling the bottom layer 1020 beneath the adhesive layer 1015 to seal the center cutouts 1025 of the stiffener sheet 1000. Alternatively, the method of constructing the keyboard dome stiffener assembly 5000 can include coupling a spacer (not shown) between the dome sheet 3000 and the circuit board 2000. As described above, the dome switch 3015 can be electrically coupled to each dome pad 2005 of the circuit board, such that the dome switch 3015 is disposed beneath the dome sheet 3000 and provides the top boundary for the air space 3005 associated with the dome pad 2005. The adhesive dab 3020 can be coupled to the dome switch 3015 in between the dome switch 3015 and the dome sheet 3000. The adhesive dab 3020 can affix or hold the dome switch 3015 in place over the dome pad 2005 of the circuit board 2000.

The keyboard dome stiffener assembly 5000 can then be assembled or coupled to an associated keyboard of a handheld device. In at least one embodiment, the keyboard dome stiffener assembly 5000 can be coupled to an associated keyboard by clamping the associated keyboard to hooks 3025 (as illustrated in at least FIG. 5) disposed along the perimeter of the keyboard dome stiffener assembly 5000. In other alternative embodiments, the associated keyboard can be adhered to the dome sheet 3000, bolted or screwed onto the keyboard dome stiffener assembly 5000, or affixed to the keyboard dome stiffener assembly 5000 by any other means that permits the keys, keycaps, or buttons of the associated keyboard to align with the dome pads 2005 and dome switches 3015 of the keyboard dome stiffener assembly 5000.

Figure 9:
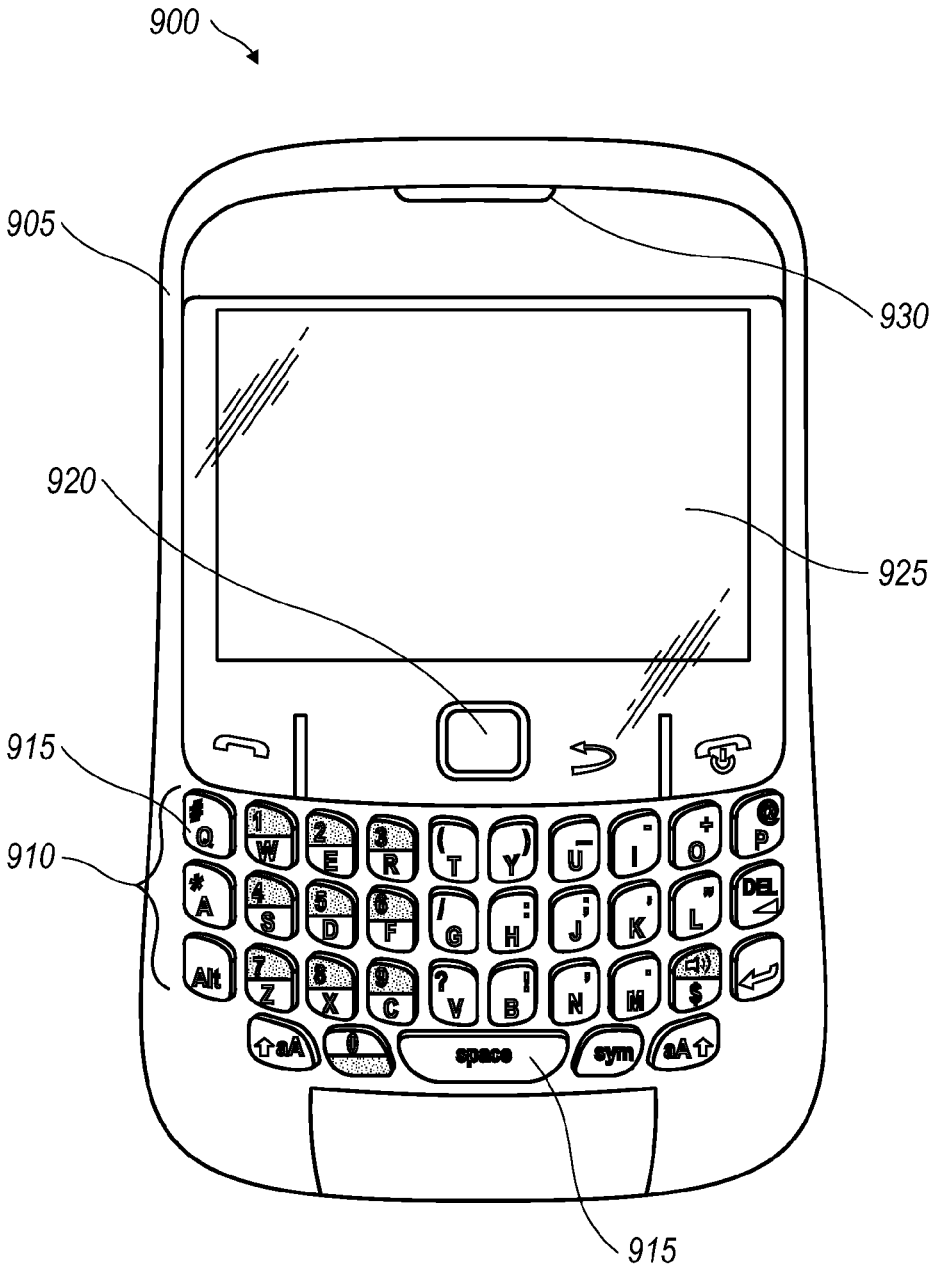
FIG. 9 is an elevation view of an exemplary mobile device having a keyboard dome stiffener assembly in accordance with an exemplary embodiment.

FIG. 9 is an elevational view of an exemplary mobile device having a keyboard dome stiffener assembly in accordance with an exemplary embodiment. The mobile device illustrated in FIG. 9 is a handheld telecommunication device 900. The handheld telecommunication device 900 includes a housing having a first or front face 905. A display screen 925 is disposed on the front face 905 of the housing, and more specifically is disposed between an audio port 930 and a navigation tool 920. A keyboard 910 comprising a plurality of keys 915 can be disposed below the navigation tool 920. The illustrated keyboard 910 is a full text-entry keyboard having keys 915 arranged in a traditional keyboard array, although a reduced keyboard or other keyboard layouts are also possible. The keys 915 have at least one of numeric indicia, alphabetic indicia, and symbolic indicia. FIG. 9 shows the keys 915 of the keyboard 910 arranged in a QWERTY keyboard layout. However, one of ordinary skill in the art will appreciate that the keys 915 can be arranged in a QWERTZ keyboard layout, Dvorak keyboard layout, a Japanese keyboard layout, a Chinese keyboard layout, an AZERTY keyboard layout, or any other keyboard layout that facilitates text entry into a mobile device. Beneath the keyboard 910 is the keyboard dome stiffener assembly (not shown) described in the previous paragraphs. Each key 915 of the keyboard 910 is associated with a corresponding dome switch and dome pad of the keyboard dome stiffener assembly.

Figure 10:
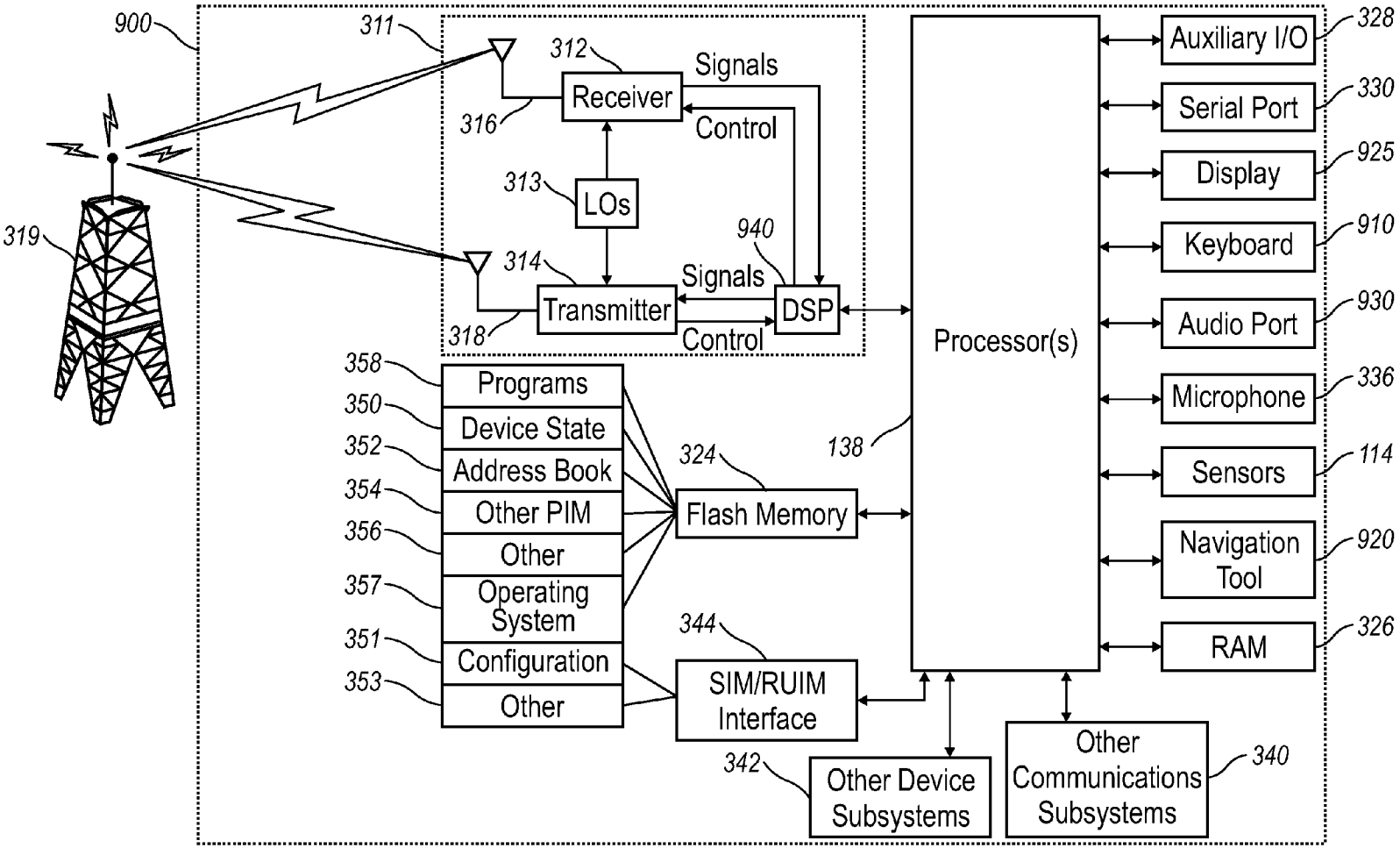
FIG. 10 is a block diagram illustrating the communication between a mobile device and a processor coupled with a keyboard dome stiffener assembly in accordance with an exemplary embodiment.

FIG. 10 is a block diagram of the mobile device 900 depicted in at least FIG. 8 that includes a keyboard dome stiffener assembly in accordance with any of the embodiments described herein. A communication subsystem 311 performs all communication transmission and reception with a wireless network 319. A processor module 138 further can be connected with an auxiliary input/output (I/O) subsystem 328 which can be connected to the communication device 900. In at least one embodiment, the processor module 138 can be connected to a serial port (for example, a Universal Serial Bus port) 330 which can allow for communication with other devices or systems. The display 925 can be connected to the processor module 138 to allow for displaying of information to an operator of the communication device 900. When the communication device 900 is equipped with the keyboard 910, the keyboard 910 can also be connected with the processor module 138. The keyboard 910 can be coupled to the keyboard dome stiffener assembly 5000 as described herein. In the presently described embodiment, a keyboard controller is in communication with the processor in order to send or relay messages corresponding to key pressings of the keyboard 910 to the processor 138. The dome switches 3015 and the circuit board 2005 are in communication with the keyboard controller and the processor module 138 to send and relay messages corresponding to key pressings of the keyboard 910. The communication device 900 can include the audio port 930, a microphone 336, random access memory (RAM) 326, and flash memory 324, all of which can be connected to the processor module 138. Other similar components can be provided on the device 900 as well and optionally connected to the processor module 138. Other communication subsystems 340 and other communication device subsystems 342 are generally indicated as being functionally connected with the processor module 138 as well. An example of the communication subsystem 340 is that of a short range communication system such as BLUETOOTH® communication module or a WI-FI® communication module (a communication module in compliance with IEEE 802.11 set of protocols) and associated circuits and components. The processor module 138 is able to perform operating system functions and enables execution of programs on the communication device 900. In some embodiments not all of the above components can be included in the communication device 900.

The auxiliary I/O subsystem 328 can take the form of a trackpad navigation tool 920 as illustrated in the examplary embodiment shown in FIG. 8, or a trackball, a thumbwheel, a navigation pad, a joystick, touch-sensitive interface, or other I/O interface. While the above examples have been provided in relation to the auxiliary I/O subsystem 328, other subsystems capable of providing input or receiving output from the communication device 900 are considered within the scope of this disclosure. Other keys can be placed along the side of the communication device 900 to function as escape keys, volume control keys, scrolling keys, power switches, or user programmable keys, and can likewise be programmed accordingly.

Furthermore, the communication device 900 is equipped with components to enable operation of various programs, as shown in FIG. 10. In an examplary embodiment, the flash memory 324 is enabled to provide a storage location for the operating system 357, device programs 358, and data. The operating system 357 is generally configured to manage other programs 358 that are also stored in memory 324 and executable on the processor. The operating system 357 honors requests for services made by programs 358 through predefined program 358 interfaces. More specifically, the operating system 357 typically determines the order in which multiple programs 358 are executed on the processor and the execution time allotted for each program 358, manages the sharing of memory 324 among multiple programs 358, handles input and output to and from other device subsystems 342, and so on. In addition, operators can typically interact directly with the operating system 357 through a user interface which can include the keyboard 910 and display screen 925. While in an examplary embodiment the operating system 357 is stored in flash memory 324, the operating system 357 in other embodiments is stored in read-only memory (ROM) or similar storage element (not shown). As those skilled in the art will appreciate, the operating system 357, device program 358 or parts thereof can be loaded in RAM 326 or other volatile memory.

In one examplary embodiment, the flash memory 324 contains programs 358 for execution on the communication device 900 including an address book 352, a personal information manager (PIM) 354, and the device state 350. Furthermore, programs 358 and other information 356 including data can be segregated upon storage in the flash memory 324 of the communication device 900.

When the communication device 900 is enabled for two-way communication within the wireless communication network 319, it can send and receive messages from a mobile communication service. Examples of communication systems enabled for two-way communication include, but are not limited to, the General Packet Radio Service (GPRS) network, the Universal Mobile Telecommunication Service (UMTS) network, the Enhanced Data for Global Evolution (EDGE) network, the Code Division Multiple Access (CDMA) network, High-Speed Packet Access (HSPA) networks, Universal Mobile Telecommunication Service Time Division Duplexing (UMTS-TDD), Ultra Mobile Broadband (UMB) networks, Worldwide Interoperability for Microwave Access (WiMAX), and other networks that can be used for data and voice, or just data or voice. For the systems listed above, the communication device 800 can require a unique identifier to enable the communication device 900 to transmit and receive messages from the communication network 319. Other systems may not require such identifying information. GPRS, UMTS, and EDGE use a Subscriber Identity Module (SIM) in order to allow communication with the communication network 319. Likewise, most CDMA systems use a Removable User Identity Module (RUIM) in order to communicate with the CDMA network. The RUIM and SIM card can be used in multiple different communication devices 900. The communication device 800 can be able to operate some features without a SIM/RUIM card, but it will not be able to communicate with the network 319. A SIM/RUIM interface 344 located within the communication device 900 allows for removal or insertion of a SIM/RUIM card (not shown). The SIM/RUIM card features memory and holds key configurations 351, and other information 353 such as identification and subscriber related information. With a properly enabled communication device 900, two-way communication between the communication device 900 and communication network 319 is possible.

If the communication device 900 is enabled as described above or the communication network 319 does not require such enablement, the two-way communication enabled communication device 900 is able to both transmit and receive information from the communication network 319. The transfer of communication can be from the communication device 900 or to the communication device 900. In order to communicate with the communication network 319, the communication device 900 in the presently described examplary embodiment is equipped with an integral or internal antenna 318 for transmitting messages to the communication network 319. Likewise the communication device 900 in the presently described examplary embodiment is equipped with another antenna 316 for receiving communication from the communication network 319. These antennae (316, 318) in another examplary embodiment are combined into a single antenna (not shown). As one skilled in the art would appreciate, the antenna or antennae (316, 318) in another embodiment are externally mounted on the communication device 900.

When equipped for two-way communication, the communication device 900 features the communication subsystem 311. As is understood in the art, this communication subsystem 311 is modified so that it can support the operational needs of the communication device 900. The subsystem 311 includes a transmitter 314 and receiver 312 including the associated antenna or antennae (316, 318) as described above, local oscillators (LOs) 313, and a processing module 940 which in the presently described examplary embodiment is a digital signal processor (DSP) 940.

It is contemplated that communication by the communication device 900 with the wireless network 319 can be any type of communication that both the wireless network 319 and communication device 900 are enabled to transmit, receive and process. In general, these can be classified as voice and data. Voice communication generally refers to communication in which messages for audible sounds are transmitted by the communication device 900 through the communication network 319. Data generally refers to all other types of communication that the communication device 900 is capable of performing within the constraints of the wireless network 319.

Example device programs that can depend on such data include email, contacts and calendars. For each such program, synchronization with home-based versions of the programs can be desirable for either or both of their long term and short term utility. As an example, emails are often time sensitive, so substantially real time synchronization can be desired. Contacts, on the other hand, can be usually updated less frequently without inconvenience. Therefore, the utility of the communication device 900 is enhanced when connectable within a communication system, and when connectable on a wireless basis in the network 319 in which voice, text messaging, and other data transfer are accommodated.

As indicated above, because the keyboard dome stiffener assembly comprises a dome sheet, a circuit board having a plurality of venting apertures, and a stiffener having a plurality of cutouts in fluid communication with the venting apertures, an air space associated with each key of the keyboard is formed beneath the dome sheet above the dome pad such that it is in fluid communication with an air cavity formed by one of the cutouts of the stiffener. The fluid communication between the air cavity and the air space enhances the tactile feel of the keyboard when a user actuates the keys of the keyboard. The keyboard dome stiffener assembly reduces the rigidity of a traditional dome switch and reduces the pushing force required to actuate the keys and to close the dome switches which are necessary to enter input to the mobile device. Additionally, the keyboard dome stiffener assembly enhances and increases the deflection of the dome sheet and the dome switch, thereby enhancing the tactile feedback to the user and informing the user that a dome switch has successfully closed, a key has been successfully actuated, or input has been entered to the mobile device. Thus, user frustration in actuating the keyboard and entering input to the mobile device can be reduced by implementing the present keyboard dome stiffener assembly in a mobile device. While the illustrated embodiment shows a mobile device 900 that is a handheld communication device, the mobile device can also be a PDA, a walkie-talkie, a GPS device, a handheld mobile translator, a netbook, a notebook computer, a laptop, a GPS device, a messaging device, a handheld gaming device, or any other mobile device that includes a keyboard, keypad, or switch panel.

Examplary embodiments have been described hereinabove regarding the implementation of a keyboard dome stiffener assembly to enhance tactile feedback during operation of the keyboard of a mobile device. However, one of ordinary skill in the art will appreciate that the method can be implemented on other devices, such as computing devices, PDAs, cellphones, or other devices utilizing keyboard, keypads, or switch panels to input data to a mobile device. Various modifications to and departures from the disclosed embodiments will occur to those having skill in the art. The subject matter that is intended to be within the spirit of this disclosure is set forth in the following claims.

What is claimed is:

1. A mobile device comprising:

a housing having a front face;

a display screen disposed on the front face; and a keyboard disposed on the front face adjacent to the display screen, said keyboard comprising:

a circuit board having a plurality of dome pads, each of said plurality of dome pads corresponding to a key of the keyboard and each dome pad defining a venting aperture;

a dome sheet disposed over the circuit board, said dome sheet configured to form an air space over each dome pad; and a stiffener disposed beneath the circuit board, said stiffener comprising a top layer and a bottom layer beneath the top layer, and the top layer defining a plurality of cutouts, each of said cutouts providing a sealed air cavity between the circuit board and the bottom layer of the stiffener, wherein each sealed air cavity is in fluid communication with at least one of the air spaces associated with each dome pad, and whereby when one of the keys of the keyboard is depressed, some of the air travels between the air space associated with the key of the keyboard to the corresponding sealed air cavity.

2. The mobile device of claim 1, wherein, in an assembled configuration, the cutouts are sealed by the circuit board and the plurality of venting apertures are exposed to the air space between the dome sheet and the dome pad.

3. The mobile device of claim 1 further comprising a dome switch electrically coupled to each of the plurality of dome pads, said dome switch interposed between the dome sheet and the circuit board.

4. The mobile device of claim 1, wherein each of the plurality of dome pads comprises an inner trace and an outer trace, and wherein said venting aperture is defined between the inner trace and the outer trace.

5. The mobile device of claim 1, wherein each of the cutouts comprises a center cutout and at least one air channel extending radially from the center cutout.

6. The mobile device of claim 5, wherein, in an assembled configuration, the air channel fluidly couples the air cavity to one of the plurality of apertures.

7. An assembly for a keyboard comprising:

a circuit board having a plurality of dome pads, each of said plurality of dome pads corresponding to a key of the keyboard and each dome pad defining a venting aperture;

a dome sheet disposed over the circuit board, said dome sheet configured to form an air space associated with each dome pad and in fluid communication with the venting aperture of each associated dome pad; and a stiffener disposed beneath the circuit board comprising a top layer and a bottom layer beneath the top layer, and said top layer defining a plurality of cutouts corresponding to each of the venting apertures, each of said cutouts providing a sealed air cavity between the circuit board and the bottom layer of the stiffener, wherein each sealed air cavity is in fluid communication with at least one air space, and whereby when one of the keys of the keyboard is depressed, some of the air travels between the air space associated with the key of the keyboard to the corresponding sealed air cavity.

8. The assembly of claim 7, wherein, in an assembled configuration, the cutouts are sealed by the circuit board and the plurality of venting apertures are exposed to the air space between the dome sheet and the dome pad.

9. The assembly of claim 7 wherein each of the plurality of dome pads comprises an inner trace and an outer trace, with said venting aperture defined between the inner trace and the outer trace.

10. The assembly of claim 7, wherein each of the plurality of cutouts comprises a center cutout providing the air cavity and at least one air channel extending radially from the center cutout, said air channel fluidly coupling the air cavity to one of the plurality of apertures.

11. The assembly of claim 7 further comprising a top adhesive layer disposed on top of the stiffener.

12. The assembly of claim 11 further comprising a plurality of openings defined by the top adhesive layer, each of the plurality of openings corresponding to one of the venting apertures and configured for fluid communication with at least one of the cutouts.

13. The assembly of claim 7, wherein the keys of the keyboard are arranged in one of a QWERTY layout, a QWERTZ layout, an AZERTY layout, reduced QWERTY layout, a reduced QWERTZ layout, and a reduced AZERTY layout.

14. The assembly of claim 7 further comprising a dome switch electrically coupled to each of the plurality of dome pads, said dome switch interposed between the dome sheet and the circuit board.

15. A method of constructing a stiffener for a keyboard comprising:

forming a venting aperture within each dome pad of a circuit board;

forming a plurality of cutouts on a top layer of a stiffener sheet wherein each cutout corresponds to at least one of the venting apertures;

coupling the stiffener sheet to the circuit board such that the plurality of cutouts are aligned with its corresponding venting aperture to form a sealed air cavity between a bottom layer of the stiffener sheet and the circuit board;

coupling the dome sheet to a top of the circuit board such that an air space is formed above each dome pad and such that each sealed air cavity is in fluid communication with at least one of the air spaces formed above each dome pad, wherein the venting apertures are exposed to the air space, and whereby when one of a key of the keyboard is depressed, some of the air travels between the air space associated with the key of the keyboard to the corresponding sealed air cavity.

16. The method of claim 15, wherein said cutouts include a center cutout and at least one air channel extending radially from the center cutout.

17. The method of claim 16, wherein forming a plurality of cutouts comprises:

forming the at least one air channel on the stiffener sheet such that each venting aperture corresponds to one of the at least one air channel, said air channel fluidly coupling the venting aperture to the air cavity.

18. The method of claim 17 further comprising:

coupling an adhesive layer to a rear surface of the stiffener sheet to seal the at least one air channel of the stiffener sheet;

coupling a bottom beneath the adhesive layer to seal the center cutouts of the stiffener sheet.

* * * * *